US009494395B1

(12) United States Patent
Smallin

(10) Patent No.: US 9,494,395 B1
(45) Date of Patent: Nov. 15, 2016

(54) RECONFIGURABLE MINE EMULATION SYSTEM

(71) Applicant: Bryan J. Smallin, Panama City, FL (US)

(72) Inventor: Bryan J. Smallin, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 89 days.

(21) Appl. No.: 13/975,791

(22) Filed: Aug. 26, 2013

(51) Int. Cl.
*F41A 33/00* (2006.01)
*F42B 8/28* (2006.01)

(52) U.S. Cl.
CPC ..... *F42B 8/28* (2013.01)

(58) Field of Classification Search
CPC ..... B63G 8/33
USPC ..... 434/11
See application file for complete search history.

(56) References Cited

U.S. PATENT DOCUMENTS 5,490,473 A * 2/1996 Chace et al. ..... 114/330
5,537,947 A * 7/1996 Couture et al. ..... 114/20.1
5,713,293 A * 2/1998 Shiffler et al. ..... 114/61.27
8,161,899 B1 * 4/2012 Smallin ..... 114/238

* cited by examiner

*Primary Examiner* — Kesha Frisby
(74) *Attorney, Agent, or Firm* — James T. Shepherd

(57) ABSTRACT

A mine emulation system includes a standard electronics section. The system can be reconfigured into several different mine shapes by the use of different end sections attached to the electronics section. The electronics sections can include an array of sensors, including magnetic, seismic, pressure and passive acoustic sensors. The electronics can be programmable such that the sensors can emulate the various mine types as well as differing mines within each type. An active acoustic communication system allows surface ships or RF buoy systems to communicate with the mine emulator. An operator can provide a release command to an acoustically operated release system via the acoustic communication system.

18 Claims, 4 Drawing Sheets

RECONFIGURABLE MINE EMULATION SYSTEM

STATEMENT OF GOVERNMENT INTEREST

The invention described herein may be manufactured and used by or for the Government of the United States of America for governmental purposes without the payment of any royalties.

BACKGROUND OF THE INVENTION (1) Field of the Invention

The present invention relates to emulation systems. More particularly, the present invention relates to a mine emulation system that uses a standard or common electronics section that can be reconfigured into several different mine shapes by the use of different end sections.

(2) Description of the Prior Art

Mine simulators or emulation systems are used in navy training exercises. The mine simulators are placed in known locations and the exercises include training in the use of mine detection systems to detect the mine simulators. The mine simulators can be of numerous types, including air dropped mines, submarine, launched mines, bottom mines, or moored mines.

As can be expected, the maintenance requirements for systems subjected to underwater environments are substantial, especially for electronic components. The various types of mine simulators each have their own configuration and simulation electronics. As a result, current practices maintain an inventory of spare parts for each type of mine emulator. Also, personnel responsible for maintenance are required to be familiar with each type of emulator and its spare parts requirements.

Accordingly, there exists a need to standardize the components of the mine simulators such that fewer spare parts are needed to maintain the systems. Additionally, there exists a need to standardize components to provide for reduced training requirements and easier maintenance of the mine emulation system.

SUMMARY OF THE INVENTION

It is therefore a general purpose and primary object of the present invention to provide a mine emulation system having functional mine emulators utilizing a standard or common electronics section. The system can be reconfigured into several different mine shapes by the use of different end sections attached to the standard electronics section. The end sections can be configured to emulate air dropped, submarine launched, bottom, or moored mines.

The electronics section can include an array of sensors that emulate those of the various types of mines, including magnetic, seismic, pressure and passive acoustic sensors. The electronics can be programmable to emulate the various mine types as well as differing mines within each type.

An active acoustic communication system allows surface ships or Rf buoy systems to communicate with a single mine emulator, or a field of mine emulators for real time mine firing data. The acoustic communication system also allows for diver-less deployment and recovery of the mine emulator. An operator can provide a release command to an acoustically operated release system via the acoustic communication system.

In one embodiment, a mine emulation system has a plurality of configurations for emulating a plurality of mine types. The system includes an electronics section, a plurality of forward sections and a plurality of rear sections. Each of the forward sections is connectable to a first end of the electronics section. Each of the rear sections is connectable to a second end of the electronics section opposite the first end. Each one of the plurality of configurations includes the electronics section, one of the plurality of forward sections and one of the plurality of rear sections.

For a given configuration, the electronics section can include a programmable processor running an emulation algorithm corresponding to that given configuration. The system can include one or more sensors in communication with the processor. The processor operates on signals from the sensors that correspond to the given configuration.

The electronics section can also include at least one communication hydrophone disposed on an outer casing of the electronics section. A releasable band can secure the electronics section to the rear section. The processor can operate to release the band based on a signal received at the communication hydrophone.

The electronics section can also include one or more passive hydrophones, magnetometers, seismic sensors, pressure sensors, or inclinometers. The seismic sensor is mounted to an inside surface of the electronics section so as to detect vibrational target signatures. A pressure port is in communication with the pressure sensor and is open to the medium surrounding the system. The electronics section further includes a power source. The central processor can include a power management system in communication with the power source, such that quiescent equipment can be powered down.

In one embodiment, a method for emulating a plurality of mines includes connecting one of a plurality of forward sections to a first end of an electronics section and connecting one of a plurality of rear sections to a second end of the electronics section opposite the first end. The electronics section, the forward section and the rear section form a given mine configuration.

The electronics section monitors the surrounding environment for target signatures corresponding to the given configuration. The electronics section emulates a response for a mine corresponding to the given mine configuration when one of the target signatures is perceived. The method can further include receiving an acoustic release signal at the electronics section and disconnecting one or both of the forward section and the rear section from the electronics section based on the release signal.

Monitoring can include sensing acoustic communications signals, acoustic target signatures, magnetic target signatures, vibrational target signatures, a pressure of the surrounding environment and an orientation of the electronics section. Monitoring can also include powering down quiescent equipment within the electronics section.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like references numerals and symbols designate identical or corresponding parts throughout the several views and wherein.

DESCRIPTION OF THE INVENTION

Figure 1:
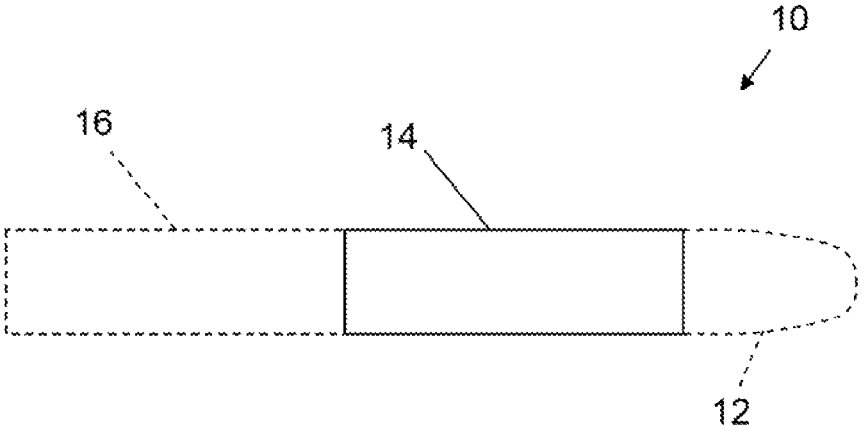
FIG. 1 illustrates a schematic side view of a generic mine emulation system.

Referring now. to FIG. 1, there is shown a schematic side view of generic mine emulation system 10. System 10 is generally cylindrical in cross section and includes forward section 12, electronics section 14, connected at one end to forward section 12, and rear section 16 connected to an opposite end of electronics section 14. System 10 can reconfigured into several mine shapes by replacing forward or nose section 12 and rear or tail section 16 with appropriately shaped sections. Electronics section 14 is common to each mine shape of system 10. Accordingly, for generic system 10 illustrated in FIG. 1, forward section 12 and rear section 16 are shown in phantom.

Figure 2:
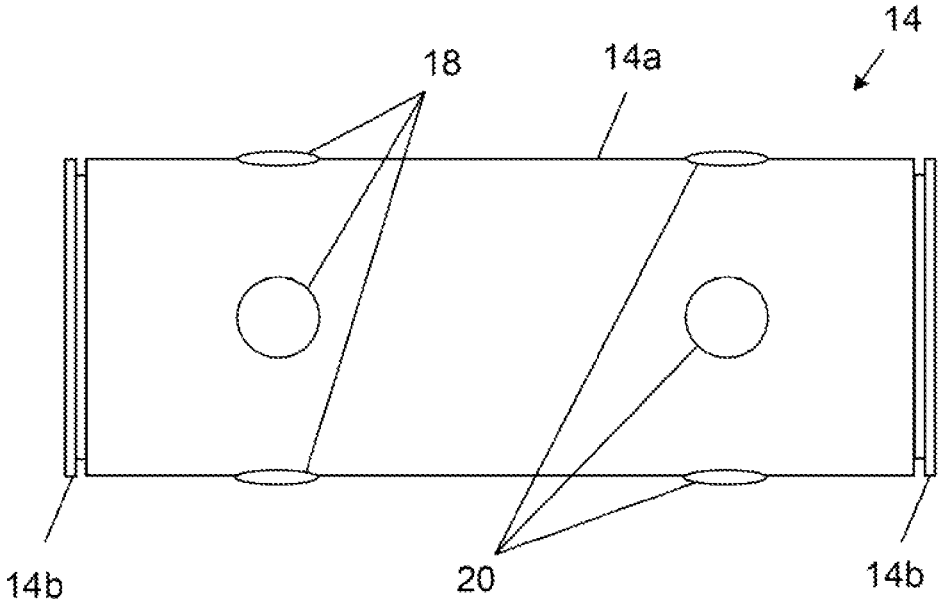
FIG. 2 illustrates a site view of an electronics section of the mine emulation system of FIG. 1.

Referring now to FIG. 2, there is shown a detailed side view of electronics section 14. Casing 14*a* is cylindrical in cross section with mounting flanges 14*b* at each end to accommodate respective forward and rear sections 12 and 16. Passive acoustic hydrophones 18 are mounted on casino 14*a* to detect passing targets used in the training exercises.

For illustration, but not limitation, passive acoustic hydrophones 18 illustrated in FIG. 2 as mounted in a row longitudinally and spaced 90 degrees apart radially. This configuration allows for passive acoustic hydrophones 18 to be exposed off the ocean floor no matter which way electronics section 14 lays on the ocean floor.

Similarly, communication hydrophones 20 are illustrated in FIG. 2 as mounted in a row longitudinally and spaced 90 degrees apart radially on casing 14*a*. Communication hydrophones 20 allow communication to and from electronics section 14 for data transmission and for communicating commands to electronics section 14.

Figure 3:
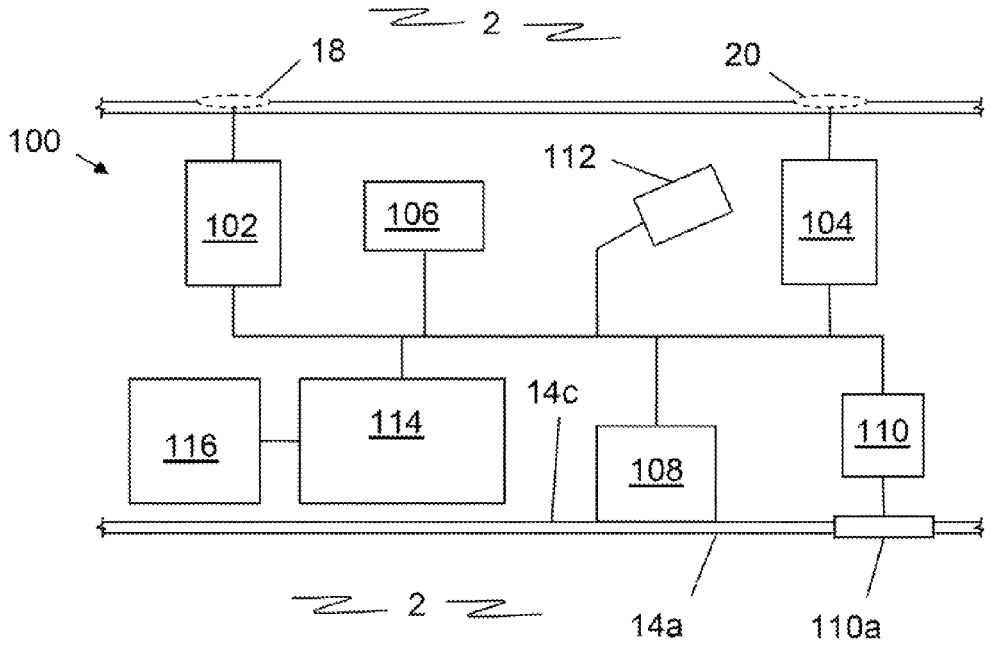
FIG. 3 illustrates a schematic representation of electronics equipment housed within the electronics section of the mine emulation system.

Referring now to FIG. 3, there is shown a schematic representation of electronics equipment 100 housed within electronics section 14 of FIG. 2. Electronics equipment 100 includes passive and communications acoustic processors 102 and 104 connected to respective passive acoustic hydrophones 18 and communications hydrophones 20 (one of each is shown in phantom in FIG. 3). Acoustic processors 102 and 104 can operate on incoming acoustic signals to discern acoustic signatures and communications from background noise.

Additionally, electronic equipment 100 includes triaxial magnetometer 106. As is known in the art, triaxial magnetometer 106 detects ship and submarine magnetic signatures, employing both dc and ac magnetic signatures so as to minimize false alarms. Accordingly, forward section 12, rear section 16 and electronics section 14 are fabricated of non-magnetic material. Also, electronic equipment 100 includes low frequency seismic sensor 108. As known in the art, seismic sensor 108 detects ship and submarine seismic signatures. Seismic sensor 108 is mounted directly to inner surface 14*c* of electronics section 14 so as to use vibrations of electronics section 14 to detect seismic events.

Electronics equipment 100 further includes differential pressure sensor 110 and inclinometer 112. As is known in the art, pressure sensor 110 detects the pressure signature being created by a ship or submarine. Pressure sensor 110 is in communication with medium 2 surrounding system 10 via external port 110*a*. For illustration, but not limitation, external port 110*a* is shown extending from inner surface 14*c* through casing 14*a* of electronics section 14. Inclinometer 112 tracks the orientation of system 10 during deployment.

Acoustic processors 102 and 104, magnetometer 106, sensors 108 and 110 and inclinometer 112 are each connected to main controller 114. Additionally, power source 116 is connected to main controller 114 and provides power for the operation of electronics equipment 100.

Figure 4:
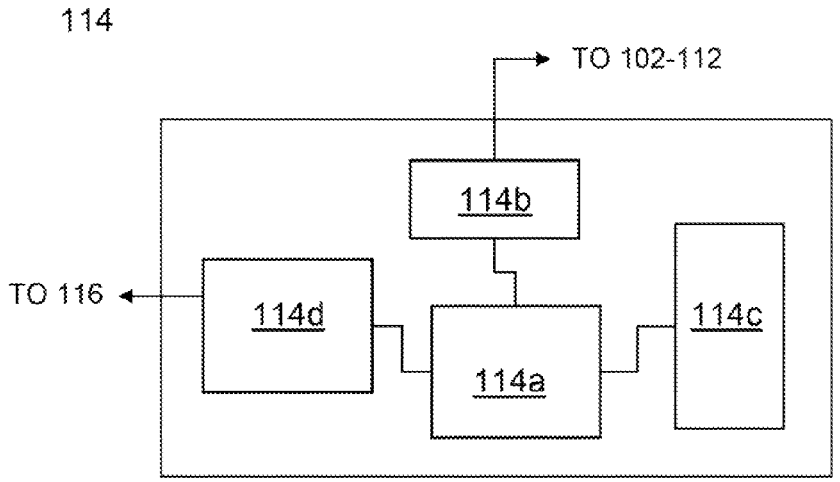
FIG. 4 illustrates a schematic representation of a main controller of the electronics equipment illustrated in FIG. 3.

Referring now also to FIG. 4, there is shown a schematic illustration of main controller 114. Main controller 114 includes central processor 114*a*, signal conditioners 114*b* and data storage 114*c*. Additionally, main controller 114 includes active power management system 114*d*, in communication with power source 116. Power management system 114*d* operates to conserve power during long exercises by shutting down quiescent equipment within electronics section 14, while awaiting signals to be received at one or more of acoustic processors 102 and 104, magnetometer 106, sensors 108 and 110 and inclinometer 112.

Central processor 114*a* is programmed with one or more mine emulation algorithms and controls the operations of system 10. Signal conditioners 114*b* condition incoming signals from one or more of acoustic processors 102 and 104, magnetometer 106, sensors 108 and 110 and inclinometer 112 (all shown in FIG. 3) for acceptance by central processor 114*a*.

Central processor 114*a* compares the incoming data to the algorithm from the programmed mine emulation to determine if the signal is from a target. Results are stored in data storage 114*c*. Data storage 114*c* can include a plurality of hard or flash drives for redundancy, which can be sealed separately for increased watertight integrity.

Referring now to FIGS. 5A through 5F, there are illustrated various configurations of mine emulation system 10. Air drop configuration 10*a*, shown in FIG. 5A, mimics in appearance, and emulates the operation of, an air dropped service mine. Rear or tail section 16*a* and forward or nose cone section 12*a* are attached to flanges 14*b* (shown in FIG. 2) of electronics section 14 by the use of quick release bands 22 and 24, respectively.

Tail section 16*a* is weighted in order to keep system configuration 10*a* on the ocean floor. Nose section 12*a* is positively buoyant to serve as a float that can bring electronics section 14 to the surface. When a release command is received via communication hydrophones 20, main controller 114 (shown in FIG. 3) of electronics section 14 can cause band 22 to open, thus releasing nose section 12*a* and electronics section 14 to float to the surface. A recovery line can be attached to tail section 16*a*, and nose section 12*a* or tail section 14, for retrieval.

Figure 5A:
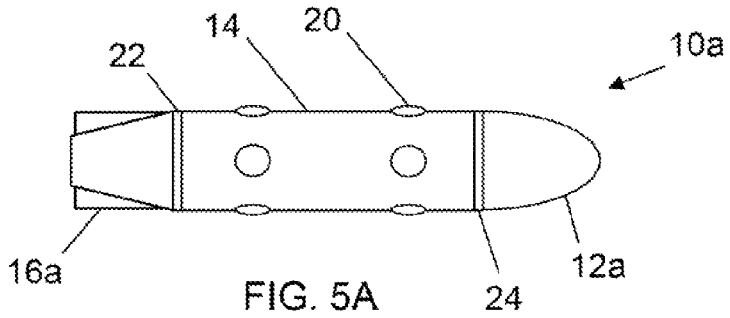
FIGS. 5A-5D illustrate alternate configurations of the mine emulation system.
Figure 5B:
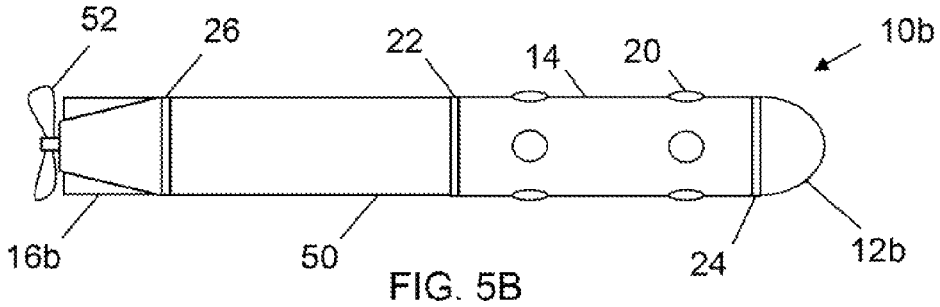

Submarine launched configuration 10*b*, shown in FIG. 5B, mimics in appearance, and emulates the operation of, a submarine launched service mine. In addition to nose section 12*b* and tail section 16*b*, configuration 10*b* is equipped with drive section 50 located between electronics section 14 and tail section 16*b*. Quick release band 26 attaches drive section 50 to tail section 16*b* in a manner similar to bands 22 and 24, previously described herein.

To fully simulate a submarine launched service mine, tail section includes rotor 52. Drive section 50 can be fully operational so as to turn rotor 52 and propel configuration 10*b*. As in the case of configuration 16*a*, nose section 12*b* is positively buoyant. When a release command is received via communication hydrophones 20, main controller 114 (shown in FIG. 3) of electronics section 14 can cause band 22 to open, thus releasing nose section 12*b* and electronics section 14 to float to the surface. Again, a recovery line can be attached to drive section 50, and nose section 12*b* or electronics section 14, for retrieval.

Figure 5C:
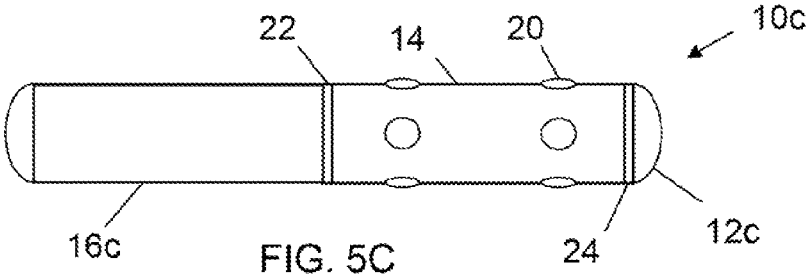

Bottom mine configuration 10*c*, shown in FIG. 5C, includes weighted ballast tail section 16*c* to maintain the mine on the ocean floor and positively buoyant nose section 12*c*. As with configuration 10*a*, bands 22 and 24 attach respective tail and nose sections 16*c* and 12*c* to electronics section 14. Again, a release command results in main controller 114 (shown in FIG. 3) opening band 22 such that nose section 12*c* and electronics section 14 can float to the surface. A recovery line can be attached to tail section 16*c*, and nose section 12*c* and electronics section 14, for retrieval.

Figure 5D:
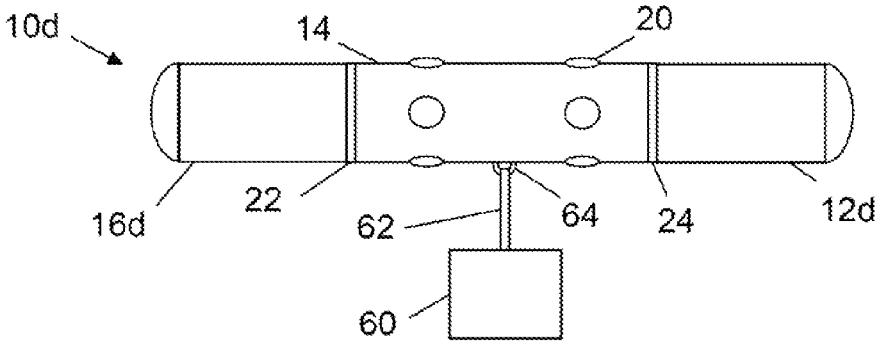

Moored configuration 10*d*, shown in FIG. 5D, includes nose section 12*d* and tail section 16*d* attached to opposite ends of electronic section 14 via respective bands 24 and 22. When attached to each other, the combination of the nose section 12*d*, tail section 16*d* and electronics section 14 is positively buoyant. Anchor 60 is connected to tether 62, which in turn connects to quick release ring 64 attached to electronics section 14. When a release command is received at communication hydrophones 20, main controller 114 (shown in FIG. 3) opens ring 64 to release entire moored configuration 10*d*, which floats to the surface for retrieval.

Figure 6:
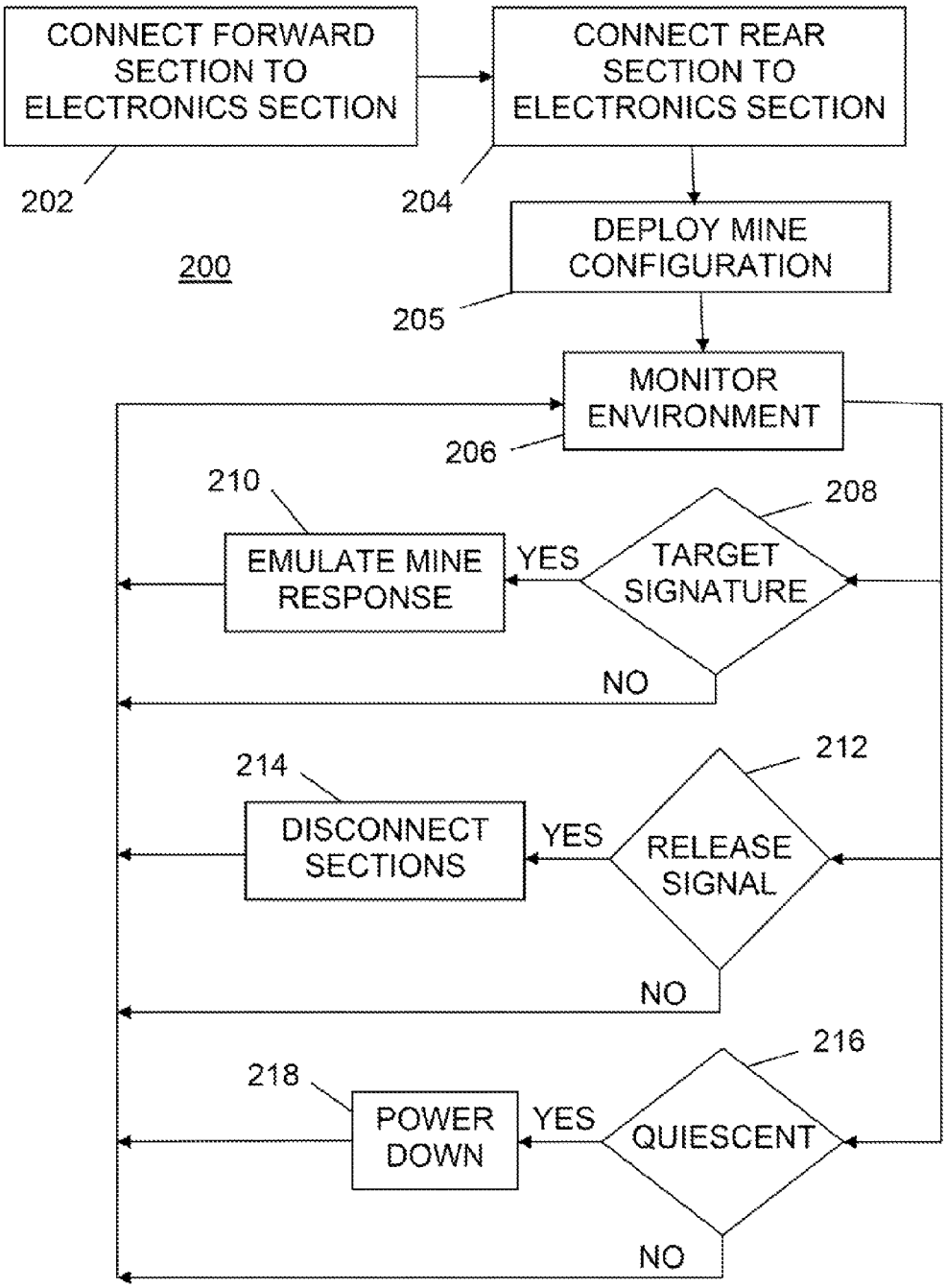
FIG. 6 is a block diagram of a method for emulating a mine using the mine emulation system of the invention.

Referring now to FIG. 6, there is shown a block diagram of method 200 for emulating a plurality of mine configurations using system 10. At block 202 one of the plurality of forward sections 12 is connected to one end of electronics section 14. At block 204, one of the plurality of rear sections 16 is connected to the opposite end of the electronics section to form the desired mine configuration, such as one of those illustrated in FIGS. 5A-5D.

After the assembled mine configuration is deployed into a surrounding environment (block 205), such as on a seafloor, the electronics section monitors the surrounding environment for target signatures corresponding to the given configuration (block 206). Monitoring can include sensing acoustic communications signals, acoustic target signatures, magnetic target signatures, vibrational target signatures, a pressure of the surrounding environment, and an orientation of the electronics section. If one of the target signatures is perceived (block 208), the electronics section emulates a response for a mine corresponding to the given mine configuration (block 210).

In addition, if an acoustic release signal is received at the electronics section (block 212), method 200 can disconnect one or both of the forward section 12 and the rear section 16 from the electronics section 14 (block 214). Also, if any of electronic equipment 100 (shown in FIG. 3) is quiescent (block 216), e.g., signal conditioners 114*b* (shown in FIG. 4), power management system 114*d* (also shown in FIG. 4) shuts or powers down the quiescent equipment (block 218) to conserve power.

Obviously many modifications and variations of the present invention may become apparent in light of the above teachings. For example, many other configurations are possible, depending on the sections attached to electronics section 14. Central processor 114*a* can be programmed to emulate the mine system matching the chosen configuration. Depending on the configuration, additional sensors may be added or some sensors can be removed to minimize power requirements or costs.

Additionally, external port 110*a* can penetrate from electronics section 14 to one or both of forward section 12 and rear section 16, which can be open to medium 2. Further, the buoyancy of nose section 12 can be sufficient to maintain one or more of configurations 10*a*-10*d* upright on the ocean floor.

What have thus been described are a mine emulation system and method having a standard or common electronics section with interchangeable nose and tail sections. The system can be reconfigured into several different mine shapes by the use of the different forward and rear sections attached to the standard electronics section. The forward and rear sections can be configured to emulate air dropped, submarine launched, bottom, or moored mines. Additionally, system 10 can be configured in a myriad of novel ways.

The electronics section can include an array of sensors that emulate those of the various types of mines, including magnetic, seismic, pressure and passive acoustic sensors. The electronics can be programmable to emulate the various mine types as well as differing mines within each type.

In addition, the electronics section can include art active acoustic communication system that allows surface ships or RF buoy systems to communicate with a single mine emulator, or a field of mine emulators for real time mine firing data. The acoustic communication system also allows for diver-less deployment and recovery of the mine emulator. The nose or forward section in a number of configurations can be positively buoyant. An operator can provide a release command to an acoustically operated release system via the acoustic communication system such that the nose and electronics sections can be released from a weighted tail section.

As described herein, the mine emulation system has a number of advantages over current mine emulation systems. The standardized electronics section of the mine emulation system requires fewer spare parts to maintain the system. Additionally, the standardized components provide for reduced training requirements and easier maintenance of the mine emulation system.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A mine emulation system having a plurality of configurations for emulating a plurality of mine types, comprising:

an electronics section;

a plurality of forward sections, each connectable to a first end of said electronics section;

a plurality of rear sections, each connectable to a second end of said electronics section opposite said first end, wherein each of said plurality of configurations comprises said electronics section, one of said plurality of forward sections and one of said plurality of rear sections, each configuration of said plurality of configurations corresponding to one of said plurality of mine types; and a processor program product disposed on a processor readable medium contained within said electronics section, and having instructions for causing said processor program product to determine said one of said plurality of mine types based on said each configuration and to emulate said one of said plurality of mine types.

2. The system of claim 1, wherein said electronics section further comprises at least one sensor in communication with said processor, wherein said processor program product operates on signals from said at least one sensor in a manner corresponding to said given one of said plurality of mine types.

3. The system of claim 1, wherein said electronics section further comprises at least one communication hydrophone disposed on an outer casing of said electronics section.

4. The system of claim 3, further comprising a releasable band securing said electronics section to a rear section of said given configuration, said processor operating to release said band based on a signal received at said communication hydrophone.

5. The system of claim 1, wherein said electronics section further comprises at least one of a passive hydrophone, a magnetometer, a seismic sensor, a pressure sensor and an inclinometer.

6. The system of claim 5, wherein said seismic sensor is mounted to an inside surface of said electronics section.

7. The system of claim 5, wherein said electronics section further comprises a pressure port in communication with said pressure sensor and open to a medium surrounding said system.

8. The system of claim 1, wherein:

said electronics section further comprises a power source; and said processor program product further comprises instructions for managing said power source.

9. The system of claim 8, wherein said electronics section further comprises at least one communication hydrophone disposed on an outer casing of said electronics section.

10. The system of claim 9, further comprising a releasable band securing said electronics section to a rear section of said given configuration, said processor program product operating to release said band based on a signal received at said communication hydrophone.

11. The system of claim 9, wherein said electronics section further comprises at least one of a passive hydrophone, a magnetometer, a seismic sensor, a pressure sensor and an inclinometer.

12. The system of claim 11, further comprising a releasable band securing said electronics section to a rear section of said given configuration, said processor program product operating to release said band based on a signal received at said communication hydrophone.

13. A method for emulating a plurality of mine types, said method comprising the steps of:

connecting one of a plurality of forward sections to a first end of an electronics section;

connecting one of a plurality of rear sections to a second end of said electronics section opposite said first end;

determining, at said electronics section, a given mine type of said plurality of mine types based on said one forward section and said one rear section connected to said electronics section;

monitoring, at said electronics section, a surrounding environment for target signatures corresponding to said given mine type; and emulating, at said electronics section, a response for a mine corresponding to said given mine type when one of said target signatures is perceived.

14. The method of claim 13, further comprising:

receiving an acoustic release signal at said electronics section; and disconnecting at least one of said one forward section and said one rear section from said electronics section based on said release signal.

15. The method of claim 13, wherein monitoring further comprises sensing at least one of acoustic communications signals, acoustic target signatures, magnetic target signatures, vibrational target signatures, a pressure of said surrounding environment and an orientation of said electronics section.

16. The method of claim 15, wherein sensing acoustic communications signals further comprises:

sensing an acoustic release signal at said electronics section; and disconnecting at least one of said one forward section and said one rear section from said electronics section based on said release signal.

17. The method of claim 16, wherein monitoring further comprises powering down quiescent equipment within said electronics section.

18. The method of claim 13, wherein monitoring further comprises powering down quiescent equipment within said electronics section.

* * * * *